US010880637B2

(12) United States Patent
Park et al.

(10) Patent No.: US 10,880,637 B2
(45) Date of Patent: Dec. 29, 2020

(54) SOUND OUTPUT APPARATUS

(71) Applicant: SAMSUNG ELECTRONICS CO., LTD., Suwon-si (KR)

(72) Inventors: Dongkyu Park, Suwon-si (KR); Sangchul Ko, Suwon-si (KR); Donghyun Jung, Suwon-si (KR); Byeonggeun Cheon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/505,101

(22) Filed: Jul. 8, 2019

(65) Prior Publication Data

US 2020/0021908 A1 Jan. 16, 2020

(30) Foreign Application Priority Data

Jul. 10, 2018 (KR) ..... 10-2018-0080232

(51) Int. Cl.

| | |
|---|---|
| ***H04R 25/00*** | (2006.01) |
| ***H04R 1/34*** | (2006.01) |
| ***H04R 1/28*** | (2006.01) |
| ***H04R 1/02*** | (2006.01) |

(52) U.S. Cl.

CPC ..... *H04R 1/345* (2013.01); *H04R 1/028* (2013.01); *H04R 1/2811* (2013.01); *H04R 2499/15* (2013.01)

(58) Field of Classification Search

CPC ..... H04R 1/345; H04R 1/028; H04R 1/2811; H04R 2499/15

USPC ..... 381/150

See application file for complete search history.

(56) References Cited

U.S. PATENT DOCUMENTS

| | | | | |
|---|---|---|---|---|
| 5,552,569 | A * | 9/1996 | Sapkowski | H04R 1/2865 181/151 |
| 5,710,394 | A * | 1/1998 | Saito | H04R 5/02 181/152 |
| 8,351,630 | B2 | 1/2013 | Ickler et al. | |
| 2012/0237070 | A1 | 9/2012 | Ickler et al. | |
| 2017/0251296 | A1 | 8/2017 | Smithers | |
| 2018/0167724 | A1 | 6/2018 | Jung et al. | |

FOREIGN PATENT DOCUMENTS

| | | | |
|---|---|---|---|
| JP | 11-234784 | A | 8/1999 |
| JP | 2009-296153 | A | 12/2009 |
| JP | 2011-97297 | A | 5/2011 |
| JP | 5388890 | B2 | 1/2014 |

(Continued)

OTHER PUBLICATIONS

Holland, et al., "A Low-Cost End-Fire Acoustic Radiator*", 1991, J. Audio Eng. Soc., vol. 39, No. 7/8, pp. 540-550.

(Continued)

*Primary Examiner* — Phylesha Dabney

(74) *Attorney, Agent, or Firm* — Sughrue Mion, PLLC

(57) ABSTRACT

Provided is a sound output apparatus including a driver configured to emit sound; a pipe including a plurality of holes that are aligned in a row in a side surface of the pipe and are configured to receive the sound emitted from the driver; and at least one cover covering the plurality of holes. Impedance values of the plurality of holes which are covered by the at least one cover are substantially equal to each other within a preset range.

12 Claims, 19 Drawing Sheets

(56) References Cited

FOREIGN PATENT DOCUMENTS

| | | | | |
|---|---|---|---|---|
| JP | 2017-69715 | A | 4/2017 | |
| JP | 2017-73712 | A | 4/2017 | |
| KR | 10-2010-0007674 | A | 1/2010 | |
| KR | 10-2018-0066923 | A | 6/2018 | |
| WO | WO-2009134591 | A1 * | 11/2009 | ..... G10K 11/26 |

OTHER PUBLICATIONS

International Search Report (PCT/ISA/210) and Written Opinion (PCT/ISA/237) dated Oct. 16, 2019 issued by the International Searching Authority in International Application PCT/KR2019/008413.

* cited by examiner $Z_{h1} \neq Z_{h2} \cdots Z_{hn-1} \neq Z_{hn}$ $Z_{tn} = Z_{hn} + Z_{an}$ $Z_{t1} \fallingdotseq Z_{t2} \cdots Z_{tn-1} \fallingdotseq Z_{tn}$

[Freq. Response No Screen Vs. #400]

[UPPER PORTION#180, LOWER PORTION#500 Directivity]

SOUND OUTPUT APPARATUS

CROSS-REFERENCE TO RELATED APPLICATION(S)

This application is based on and claims priority under 35 U.S.C. § 119 to Korean Patent Application No. 10-2018-0080232, filed on Jul. 10, 2018, in the Korean Intellectual Property Office, the disclosure of which is incorporated by reference herein in its entirety.

BACKGROUND

1. Field

The disclosure relates to a sound output apparatus, and more particularly, to a sound output apparatus operating as a directional speaker.

2. Description of Related Art

Display apparatuses display images viewable by users. The users may view broadcast images through the display apparatuses. Such display apparatuses may display broadcast images selected by the users from among broadcast signals transmitted from broadcasting stations. Broadcast technology has been changing from analog to digital in many parts of the world.

The digital broadcast transmits digital image signals and audio signals. Compared to the analog broadcast, the digital broadcast is more robust in reducing external noise, and thus has advantages, such as low data loss, easy error correction, high resolution, and a clear images and sounds. In addition, unlike the analog broadcast, the digital broadcast may provide bi-directional services.

In the display apparatuses, speakers may be provided to output audio.

Recently, display apparatuses have decreased in thickness and size, taking into account for design and space limitations. Accordingly, there is a need for placing speakers in a limited space and improving directivity and characteristics of sound.

SUMMARY

Provided is a sound output apparatus operating as a directional speaker.

Additional aspects will be set forth in part in the description which follows and, in part, will be apparent from the description, or may be learned by practice of the presented embodiments.

In accordance with an aspect of the disclosure, there is provided a sound output apparatus including a driver configured to emit sound; a pipe comprising a plurality of holes that are aligned in a row in a side surface of the pipe, and are configured to receive the sound emitted from the driver; and at least one cover covering the plurality of holes, wherein impedance values of the plurality of holes which are covered by the at least one cover are substantially equal to each other within a preset range.

The sound output apparatus may include the at least one cover in a state in which the at least one cover is not attached to the plurality of holes, and may be configured so that a sum of an impedance value of a first hole from among the plurality of holes and an impedance value of a first cover corresponding to the first hole is substantially equal to a sum of an impedance value of a second hole from among the plurality of holes and an impedance value of a second cover corresponding to the second hole, within the preset range.

The sound output apparatus may include the at least one cover that is attached to the plurality of holes, and may be configured so that an impedance value of the at least one cover is greater than an average of the impedance values of the plurality of holes and two times less than a maximum value of the impedance values of the plurality of holes.

The sound output apparatus may include the at least one cover that is attached to cover the plurality of holes from inside or outside of the pipe.

The sound output apparatus may include the at least one cover including an acoustic-resistive material, and the acoustic-resistive material including at least one of cloth, plastic, or metal.

The sound output apparatus may include the at least one cover that has a circular shape, an oval shape, or a rectangular shape.

The sound output apparatus may include the at least one cover including at least one layer of at least one acoustic-resistive material.

The sound output apparatus may include a cross-sectional area of the plurality of holes that gradually increases or decreases in a direction along the row.

The sound output apparatus may include the pipe including at least two portions, and the at least one cover including at least two covers comprising different acoustic-resistive materials that are respectively attached to the at least two portions to cover the plurality of holes in each of the at least two portions.

In accordance with another aspect of the disclosure, there is provided a display apparatus including a display; and a pair of sound output apparatuses respectively extending toward opposite sides of the display, wherein each of the pair of sound output apparatuses includes a driver configured to emit sound; a pipe including a plurality of holes that are aligned in a row in a side surface of the pipe, and are configured to receive the sound emitted from the driver; and at least one cover covering the plurality of holes, wherein impedance values of the plurality of holes which are covered by the at least one cover have substantially equal values within a preset range.

The display apparatus may include the at least one cover in a state in which the at least one cover is not attached to the plurality of holes, and may be configured so that a sum of an impedance value of a first hole from among the plurality of holes and an impedance value of a first cover corresponding to the first hole is substantially equal to a sum of an impedance value of a second hole from among the plurality of holes and an impedance value of a second cover corresponding to the second hole, within the preset range.

The display apparatus may include the at least one cover that is attached to the plurality of holes, and may be configured so that an impedance value of the at least one cover is greater than an average of the impedance values of the plurality of holes and two times less than a maximum value of the impedance values of the plurality of holes.

The display apparatus may include the at least one cover that is attached to cover the plurality of holes from inside or outside of the pipe.

The display apparatus may include the at least one cover including an acoustic-resistive material, and the acoustic-resistive material including at least one of cloth, plastic, or metal.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
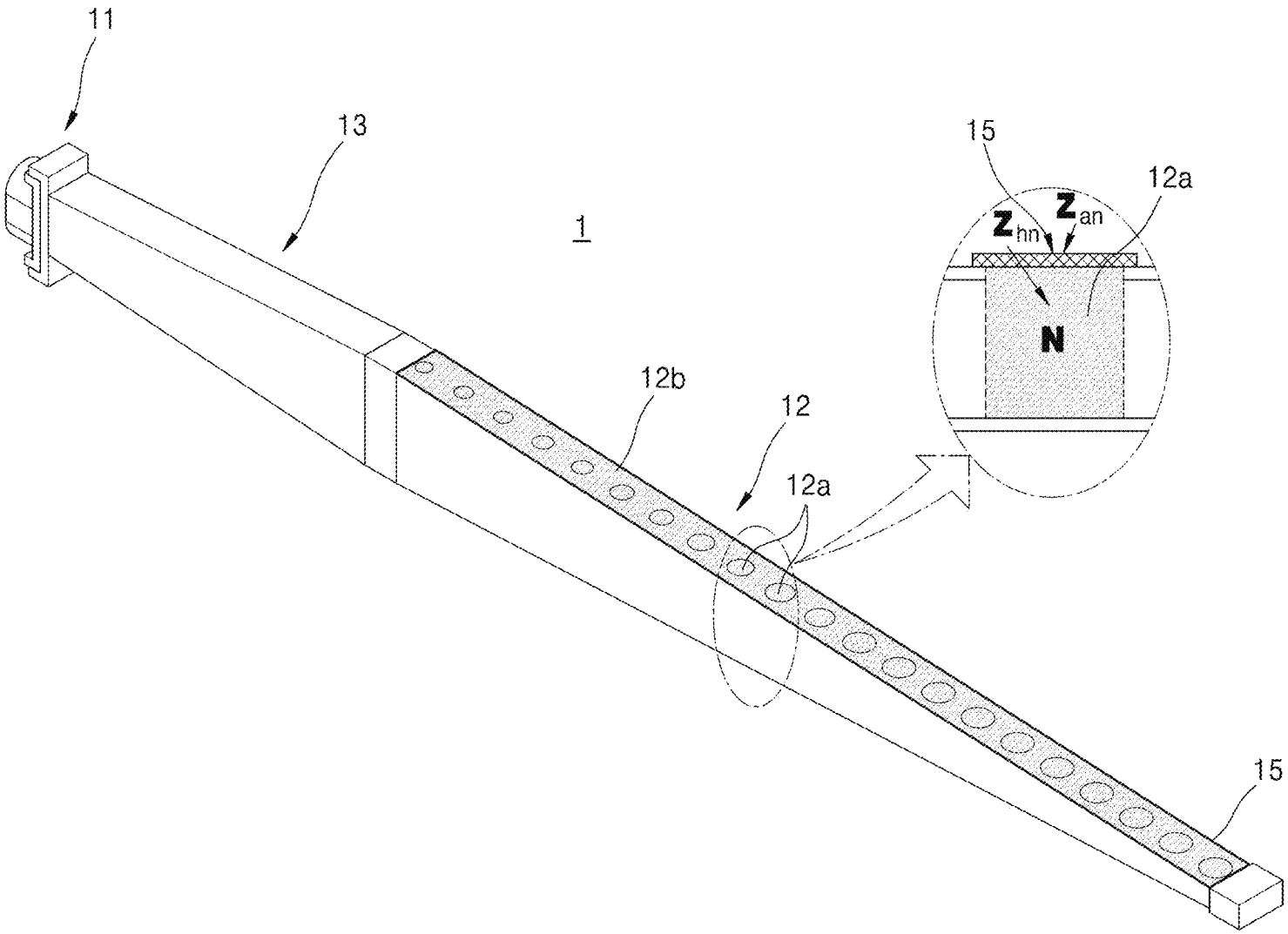
FIG. 1 is a schematic diagram of a sound output apparatus according to an embodiment.

Embodiments of the present disclosure will now be described more fully with reference to the accompanying drawings. The present disclosure may, however, be embodied in many different forms and should not be construed as being limited to the embodiments set forth herein.

The terms used in this specification are those general terms currently widely used in the art in consideration of functions regarding the disclosure, but the terms may vary according to the intention of those of ordinary skill in the art, precedents, or new technology in the art. Also, specified terms may be selected by the applicant, and in this case, the detailed meaning thereof will be described in the detailed description of the disclosure. Thus, the terms used in the specification should be understood not as simple names but based on the meaning of the terms and the overall description of the disclosure.

While terms such as "first", "second", etc., may be used herein to describe various components, such components are not limited to the above terms. The above terms are only used to distinguish one component from another.

The terms used in the present disclosure are merely used to describe particular embodiments of the disclosure, and are not intended to limit the disclosure. An expression used in the singular encompasses the expression of the plural, unless it has a clearly different meaning in the context. It will be understood that when a region is referred to as being "connected to" another region, the region may be directly connected to the other region or may electrically connected thereto with an intervening region therebetween. It will be further understood that the terms "comprises" and/or "comprising" used herein specify the presence of stated features or components, but do not preclude the presence or addition of one or more other features or components.

The use of the terms "a" and "an" and "the" and similar referents in the context of describing the disclosure may be construed to cover both the singular and the plural. Also, when a specific process order is not clearly stated, described processes may be performed in an appropriate order. Processes described in the disclosure are not limited to the described order.

Phrases such as "in some embodiments" and "in an embodiment" in the present disclosure may indicate the same or different embodiments of the disclosure.

The disclosure may be described in terms of functional block components and various processing steps. Some or all functional blocks may be realized as any number of hardware and/or software components configured to perform the specified functions. For example, the functional blocks may be realized by at least one micro-processor or circuits for performing certain functions. Also, the functional blocks may be realized with any programming or scripting language. The functional blocks may be realized in the various algorithms that are executed on one or more processors. Furthermore, the disclosure may employ any number of conventional techniques for electronics configuration, signal processing and/or control, data processing and the like. The words "mechanism", "element", "means", and "configuration" may be used broadly and may not be limited to mechanical or physical embodiments of the disclosure.

Furthermore, the connecting lines, or connectors shown in the various figures presented may be intended to represent exemplary functional relationships and/or physical or logical couplings between the various elements. It should be noted that many alternative or additional functional relationships, physical connections or logical connections may be present in a practical device.

The terms such as "front end", "rear end", "upper portion", "lower portion", "upper end", and "lower end" are defined based on the drawings, and shapes and locations of respective components are not limited to these terms.

Hereinafter, the disclosure will be described in detail with reference to the accompanying drawings.

Figure 2:
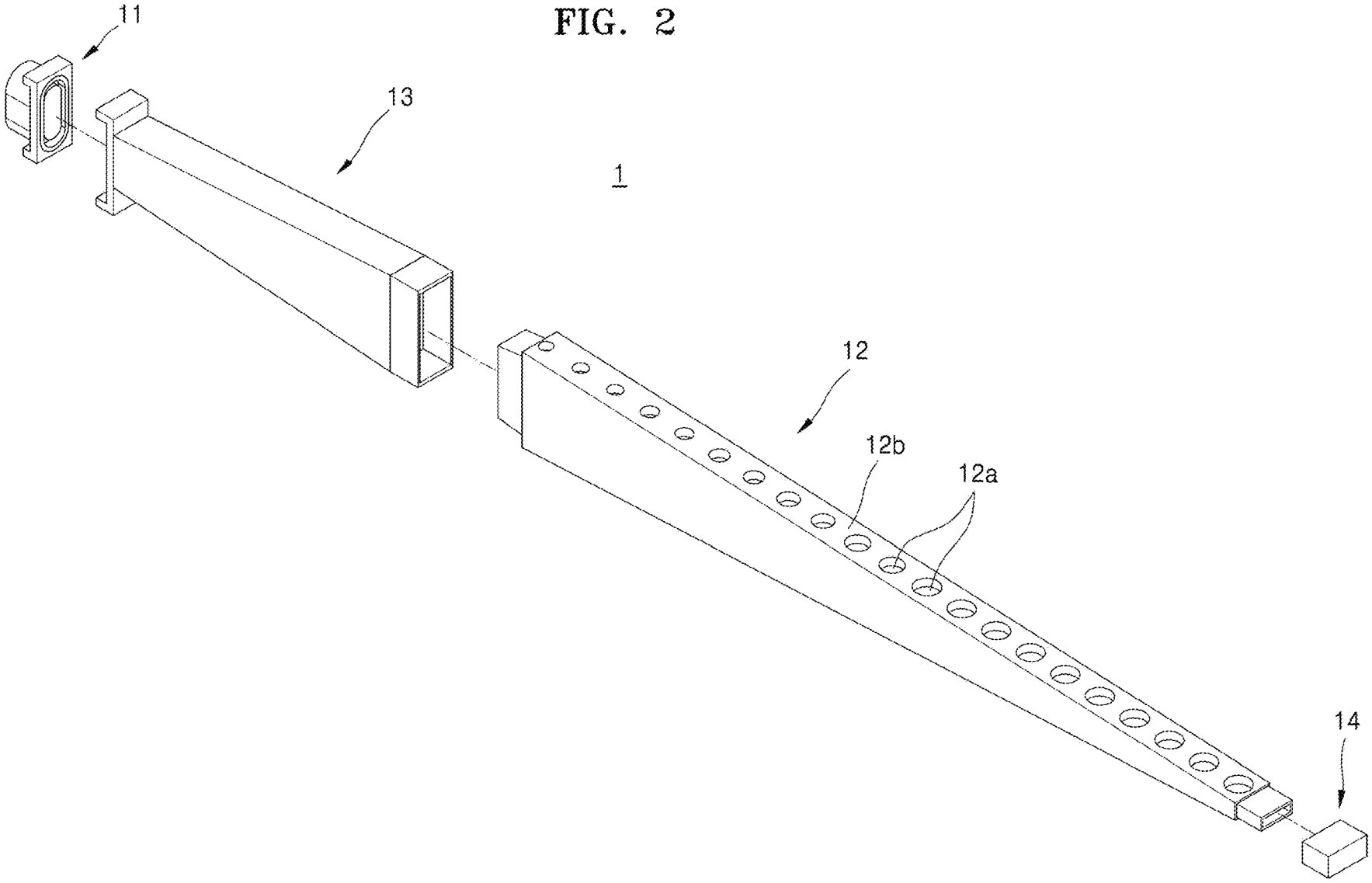
FIG. 2 is an exploded perspective view of a sound output apparatus, according to an embodiment.

FIG. 1 is a schematic diagram of a sound output apparatus 1 according to an embodiment. FIG. 2 is an exploded perspective view of the sound output apparatus 1 according to an embodiment.

The sound output apparatus 1 may have improved sound directivity as a cover 15 including acoustic-resistive material(s) is attached to a pipe 12 including holes 12*a*.

According to an embodiment, the acoustic-resistive material may include a material, for example, cloth, metal, plastic, nylon, a polymer, and/or synthetic resin, which may have acoustic resistance. However, the acoustic-resistive material is not limited thereto.

Because the pipe 12 of the sound output apparatus 1 includes the holes 12*a*, the sound output apparatus 1 may have directivity in a certain direction as sound emitted through the holes 12*a* produces a sound output effect of an array speaker.

According to an embodiment, as shown in FIG. 1, the cover 15 including an acoustic-resistive material may be attached to cover the holes 12*a*, where the holes 12*a* having different cross-sectional areas may have similar impedance values.

Respective holes 12*a* may have impedance values $Z_{hn}$ that are inversely proportional to sizes of the cross-sectional areas of the holes 12*a*. The cover 15 including the acoustic-resistive material and having an impedance value $Z_{an}$ may be attached to cover the holes 12*a*, and a sum of the impedance values of the holes 12*a* may have a value within a preset range.

Accordingly, the directivity of the sound, which is output from the sound output apparatus 1, in a certain direction may be improved.

A method of adjusting impedance values of the holes to be similar to one another by attaching the cover 15 will be described herein below in more detail with reference to FIG. 4.

According to an embodiment, a single resistive material or at least two resistive materials may be used as an acoustic-resistive material.

A size of each hole 12*a* may vary and may be determined based on the purpose and design of the sound output apparatus 1. Depending on the sizes of the cross-sectional areas of the holes 12*a*, the impedance values of the holes 12*a* may differ from one another. The cover 15 may include an acoustic-resistive material having a resistance degree. Accordingly, an impedance value of the greatest hole 12*a* and an impedance value of the smallest hole 12*a* may be adjusted to be similar to each other by attaching the cover 15 that may be configured to have different resistances for each hole depending on the impedance value of each hole 12*a*.

Also, by using the acoustic-resistive materials having the resistance degree and adjusting the impedance values of the respective holes 12*a* to be similar to one another based on the attachment of the cover 15, the cover 15 may be attached to correspond to the respective holes 12*a*.

The cover 15 may be manufactured as a separate component and attached. Also, the cover 15 may be manufactured so that it is integrated with the pipe 12.

When the cover 15 is manufactured as a separate component, a shape of the cover 15 may be a circle, an oval, a rectangle, and the like. However, the shape is not limited thereto.

The cover 15 may cover the holes 12*a* and may be attached to an outer surface or an inner surface of the pipe 12, or may be inserted in the middle of the hole 12*a*.

The cover 15 may be attached to adhere to the holes 12*a*. For example, the cover 15 may be attached according to a method (e.g., bonding, welding, etc.) of attaching a plastic material to a different material. However, the attachment methods are not limited thereto.

In addition, the cover 15 may have a multilayer structure. The covers 15 including the same acoustic-resistive material or different acoustic-resistive materials may form a multilayer structure, and then may be attached to the holes 12*a*.

Hereinafter, a structure of the sound output apparatus 1 will be described in more detail with reference to FIGS. 1 and 2.

The sound output apparatus 1 according to an embodiment may include a driver 11 that emits sound and the pipe 12 having a hollow pipe shape connected to a throat pipe 13. The sound emitted from the driver 11 may be guided through the throat pipe 13 to be emitted to the outside through the holes 12*a* in the pipe 12. The throat pipe 13 may be installed between the driver 11 and the pipe 12 and may have the driver 11 on one end and the pipe 12 on the other end.

The driver 11 may include an electromagnet that generates magnetism by receiving electrical signals, and a diaphragm that generates sound by vibrating due to the electromagnet.

The throat pipe 13 may be a hollow pipe, and the inside of the throat pipe 13 may be configured so that it is gradually increasing in width. As such, the throat pipe 13 may guide the sound generated by the driver 11 to the pipe 12, and may decrease noise that may be generated due to a drastic pressure change.

The pipe 12 includes the holes 12*a* that are aligned in a row in a lengthwise direction of the pipe 12 and allows the sound to be emitted to the outside.

According to an embodiment, the holes 12*a* may be set apart from each other at regular intervals. Also, the holes 12*a* may be set apart from each other at different intervals. However, distances between respective holes 12*a* are not limited thereto.

The holes 12*a* may be circular-shaped, and sizes thereof may increase from one end of the pipe 12, which is closer to the driver 11, to the other end of the pipe 12 that is opposite to the one end. Accordingly, a greater amount of sound may be emitted to the outside through the holes 12*a* on the other end of the pipe 12. Thus, the directivity of the sound, which is generated in a direction corresponding to the lengthwise direction of the pipe 12, may increase.

The pipe 12 that is hollow may have a rectangular cross-section, and a surface of the pipe 12, in which the holes 12*a* are formed, forms a radial surface 12*b* through which the sound is emitted.

As described above, as the holes 12*a* are aligned in a row in the radial surface 12*b* of the pipe 12, part of the sound transmitted through the throat pipe 13 may be emitted to the outside through each hole 12*a* while passing through the pipe 12.

Because sound is a wave that propagates by a pressure change in a medium, such as air, sounds emitted at different instants of time through the holes 12*a* aligned in a row in the pipe 12 may cause destructive interference and constructive interference. The sound emitted by the pipe 12 may have the directivity in the direction corresponding to the lengthwise direction of the pipe 12.

The sound output apparatus 1 may operate as a directional speaker based on a structure of the pipe 12 including the holes 12*a*.

According to an embodiment, the pipe 12 that is a hollow may have one end, on which the driver 11 is located, and the other end opposite to the one end. The pipe 12 may have a cross-section that gradually decreases from the one end to the other end.

The sound transmitted to the pipe 12 sequentially propagates through the holes 12*a* while passing through the pipe 12. Thus, the sound pressure gradually decreases as the sound passes through the pipe 12. However, as an internal cross-section of the pipe 12 gradually decreases, the sound may be emitted from the holes 12*a* that are adjacent to the other end of the pipe 12 at a level similar to a level at which the sound is emitted from other holes 12*a*.

Also, as shown in FIG. 2, a cap 14 may be located on the other end of the pipe 12 that may be opened or closed. In addition, a vertical width of an inner surface of the cap 14 that is opposite to the other end of the pipe 12 may gradually decrease towards the other end, and the other end of the pipe 12 and the inner surface of the cap 14 may contact and form a V-shaped groove. Thus, sound reaching the cap 14 may be reflected from the inner surface of the cap 14 and may cause destructive interference. Accordingly, when sound reaching the other end of the pipe 12 is reflected towards the driver 11 again, noise may be reduced. In addition, a sound-absorbing material, such as a sponge, may be located on the inner surface of the cap 14 facing the other end of the pipe 12.

Figure 3:
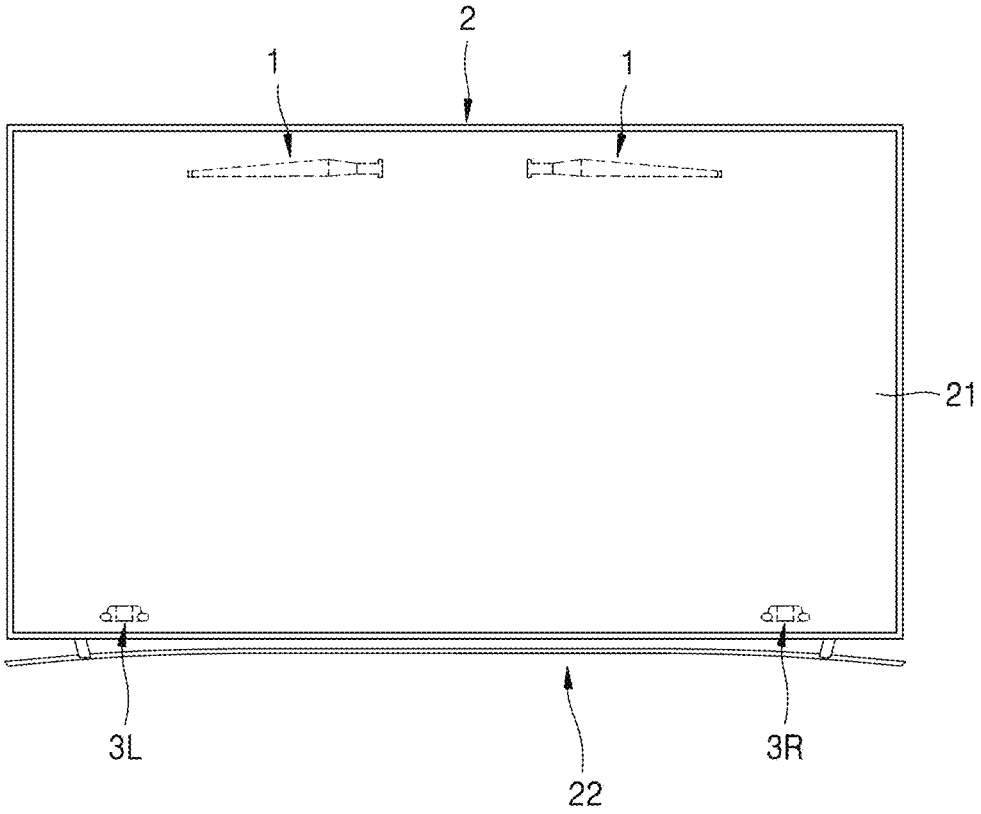
FIG. 3 is a front view of a display apparatus including a sound output apparatus according to an embodiment.

FIG. 3 is a front view of a display apparatus including sound output apparatuses according to an embodiment.

As shown in FIG. 3, the sound output apparatuses 1 may be used as surround speakers included in the display apparatus 2.

The display apparatus 2 may include a display 21 including a screen on a front surface and a stand 22 supporting the display 21. In upper rear portions of the display 21, the sound output apparatuses 1 may be embedded and may be used as the surround speakers.

Also, the display apparatus 2 may include a pair of front speakers 3L and 3R arranged on lower sides of the display 21. The display apparatus 2 may also include a woofer speaker generating sound in a low register.

The front speakers 3L and 3R enable a viewer, who is in front of the display 21, to receive sound from a frontal side of the display 21, and the front speakers 3L and 3R output sound through bottom portions of the display apparatus 2.

The sound output apparatuses 1 are symmetrically arranged on both upper sides of the display 21 and obliquely output sound towards upper side portions of the display 21 with respect to the center of the display 21. As such, because the screen is displayed on the front surface of the display 21, the sound output apparatuses 1 may be disposed on rear portions of the display 21 invisible to the viewer.

The driver units 11 may be respectively arranged on the sound output apparatuses 1 to face each side of the display apparatus and generate sound towards each side facing away from each other. The throat pipe 13 and the pipe 12 may be arranged in a horizontal direction of the display 21 and guide the sound generated by the driver 11 to the each side of the display 21.

The pipes 12 included in the sound output apparatuses 1 may be elongated in the horizontal direction, and the radial surfaces 12*b* of the pipes 12 may be arranged to face the upper portions of the sound output apparatuses 1.

The sound emitted from the holes 12*a* of the pipes 12 may be emitted towards the upper portions of the display 21 from the holes 12*a*. Accordingly, the sound may cause the destructive interference and the constructive interference appropriately to reduce noise, and may have the directivity in the direction corresponding to the lengthwise direction of the pipe 12. Therefore, the sound emitted from the sound output apparatus 1 obliquely propagates towards the upper side portions of the display apparatus 2 with respect to the center of the display 21.

As described above, because the sound output from the sound output apparatuses 1 has the directivity and obliquely propagates towards the upper side portions of the display apparatus 2 with respect to the center of the display 21, the sound output apparatuses 1 may be located at the center of the display 21 and a surrounding effect may be maintained.

According to an embodiment, because the holes 12*a* are formed in an upper surface of the pipe 12, the sound output apparatuses 1 may generate the sound towards the upper side portions of the display apparatus 2 with respect to the center of the display 21. However, the present disclosure is not limited thereto. For example, the sound output apparatuses 1 may be located so that the holes 12*a* of the pipe 12 may face lower portions of the display 21.

Furthermore, when the holes of the sound output apparatuses are formed to face the lower portions, the sound from the sound output apparatuses may be reflected from walls that may be located on both sides of the display unit, and may reach the viewer, maintaining a stereo effect obtained by directional speakers.

When the stereo effect is obtained by the sound output apparatuses, installation locations of the sound output apparatuses may not be limited to the upper portions of the display unit, and according to various design techniques, the sound output apparatuses may be installed on the upper and lower portions of the display or the center thereof.

According to an embodiment, the sizes of the holes 12*a* of the pipe 12 may increase from one end of the pipe 12 to the other end to improve the directivity of the sound from the sound output apparatus 1. Also, it is possible to make the sizes of the holes 12*a* be identical to each other. However, embodiments are not limited thereto.

Figure 4:
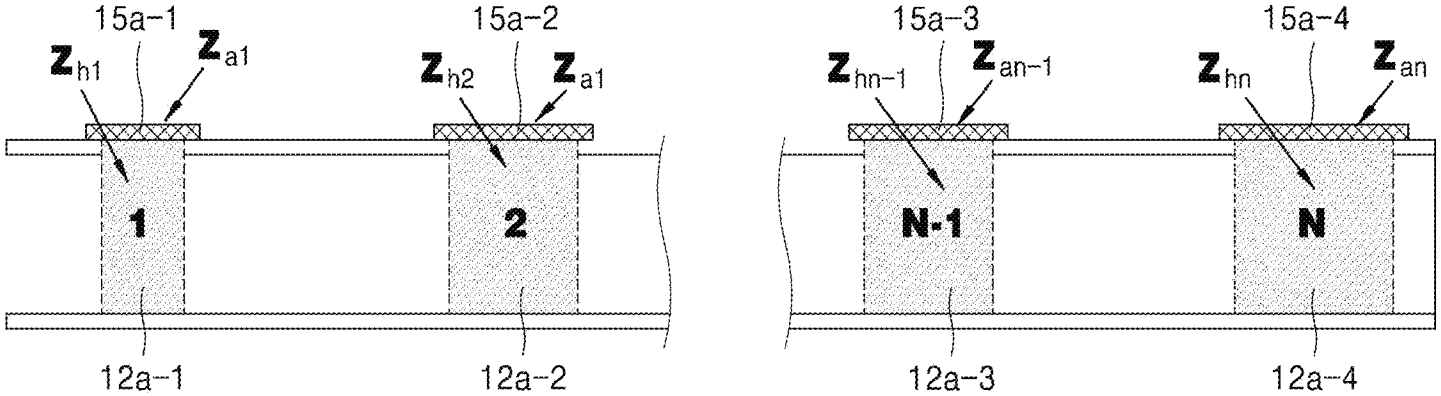
FIG. 4 is a diagram illustrating an example of covers that are attached to respective holes according to an embodiment.

FIG. 4 is a diagram illustrating an example of covers that are attached to respective holes according to an embodiment.

Referring to FIG. 4, first to fourth covers 15*a*-1, 15*a*-2, 15*a*-3, and 15*a*-4 respectively cover first to fourth holes 12*a*-1, 12*a*-2, 12*a*-3, and 12*a*-4.

According to an embodiment, impedance values $Z_{t1}$, $Z_{t2}$, $Z_{tn-1}$, . . . $Z_{tn}$ may be measured for each hole 12*a*-1, 12*a*-2, 12*an*-1, . . . 12*an*. For example, impedance values $Z_{t1}$, $Z_{t2}$, $Z_{t3}$, and $Z_{t4}$ may be measured in the first to fourth holes 12*a*-1, 12*a*-2, 12*a*-3, and 12*a*-4, respectively. The first to fourth covers 15*a*-1, 15*a*-2, 15*a*-3, and 15*a*-4 may be attached to the first to fourth holes 12*a*-1, 12*a*-2, 12*a*-3 and 12*a*-4, respectively, so that the impedance values for the first to fourth holes are close to one another within a preset range.

According to an embodiment, when an impedance value is $Z_{h1}$ in a state in which the first cover 15*a*-1 is not attached to the first hole 12*a*-1 and when an impedance value of the first cover 15*a*-1 is $Z_{a1}$, a sum of the impedance value of the first hole 12*a*-1 and the impedance value of the first cover 15*a*-1 is $Z_{t1}$. When an impedance value is $Z_{h2}$ in a state in which the second cover 15*a*-2 is not attached to the second hole 12*a*-2 and when an impedance value of the second cover 15*a*-2 is $Z_{a2}$, a sum of the impedance value of the second hole 12*a*-2 and the impedance value of the second cover 15*a*-2 is $Z_{t2}$. The sum $Z_{t1}$ may be identical or similar to the sum $Z_{t2}$.

Furthermore, impedance values $Z_{t1}$, $Z_{t2}$, $Z_{tn-1}$, and $Z_{tn}$ are respectively measured in the holes 12*a*-1, 12*a*-2, 12*an*-1, and 12*an* to which the covers 15*a*-1, 15*a*-2, 15*an*-1, and 15*an* are attached. In order to make the impedance values $Z_{t1}$, $Z_{t2}$, $Z_{tn-1}$, and $Z_{tn}$ be similar to one another within a preset range, the types and resistance values of acoustic-resistive materials forming the covers 15*a*-1, 15*a*-2, 15*an*-1 and 15*an* may be selected and attached to the holes to equalize the impedance values $Z_{t1}$, $Z_{t2}$, $Z_{tn-1}$, and $Z_{tn}$. For example, to make the impedance values $Z_{t1}$, $Z_{t2}$, $Z_{t3}$ and $Z_{t4}$ be similar to one another within a preset range, types and resistance degrees of acoustic-resistive materials forming the first to fourth covers 15*a*-1, 15*a*-2, 15*a*-3, and 15*a*-4 may be selected, and then the first to fourth covers 15*a*-1, 15*a*-2, 15*a*-3, and 15*a*-4 may be attached to the first to fourth holes 12*a*-1, 12*a*-2, 12*a*-3, and 12*a*-4.

Regarding the materials of the first to fourth covers 15*a*-1, 15*a*-2, 15*a*-3, and 15*a*-4 and the resistance degrees thereof, an optimum material may be selected such that the impedance values of the holes to which the first to fourth covers 15*a*-1, 15*a*-2, 15*a*-3, and 15*a*-4 covers are attached may be similar to one another. Otherwise, different types of optimum materials may be selected for respective holes.

Figure 5A:
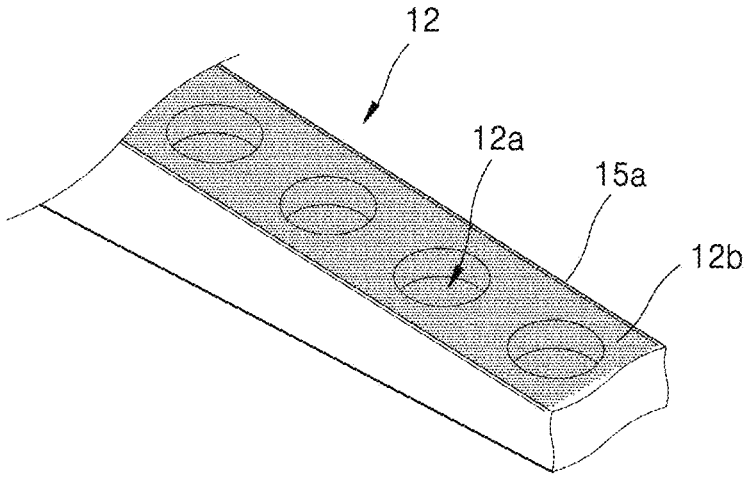
FIG. 5A is a diagram illustrating attachment locations of covers according to an embodiment.
Figure 5B:
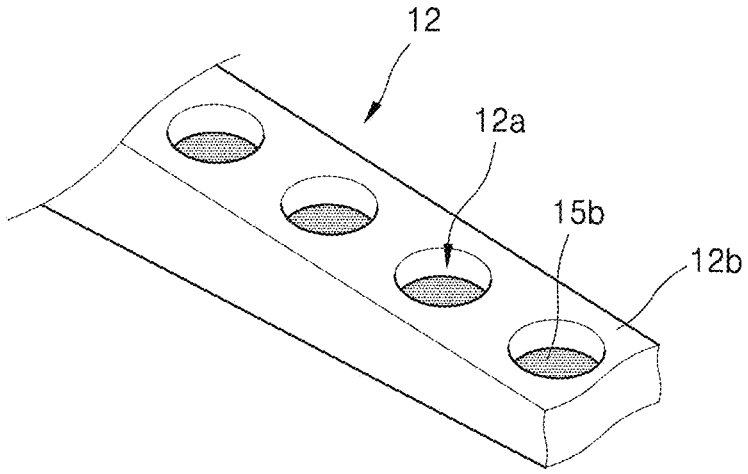
FIG. 5B is another diagram illustrating attachment locations of covers according to an embodiment.

FIGS. 5A and 5B are diagrams illustrating attachment locations of covers according to an embodiment.

As shown in FIG. 5A, a cover 15*a* may be attached to cover the hole 12*a* on an outer surface of the radial surface 12*b* of the pipe 12.

According to an embodiment, as shown in FIG. 5B, a cover 15*b* may be attached to cover the hole 12*a* from an internal surface of the radial surface 12*b* of the pipe 12.

As another example, the cover 15 may be inserted in the middle of the hole 12*a* and cover the hole 12*a*. However, embodiments are not limited thereto.

Figure 6A:
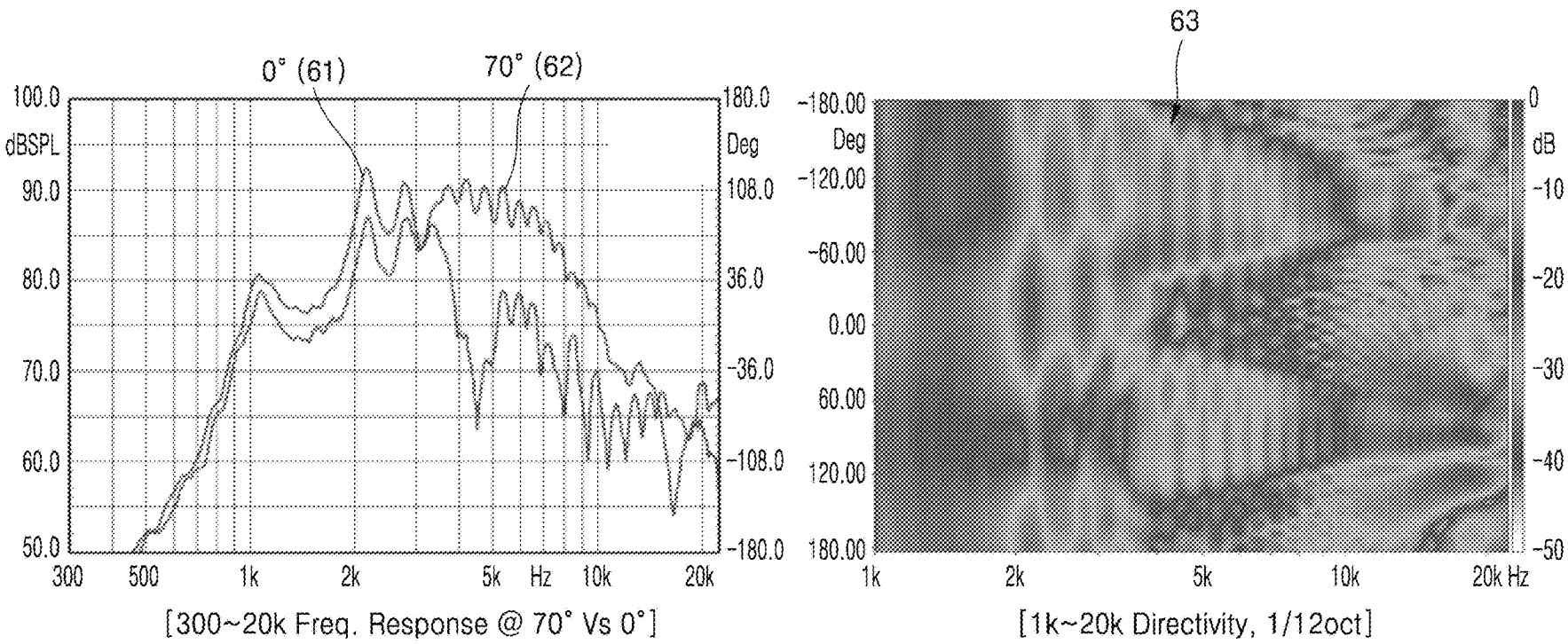
FIG. 6A is a graph and a spectrogram illustrating a change in frequency response and directivity characteristics before the attachment of covers according to an embodiment.
Figure 6B:
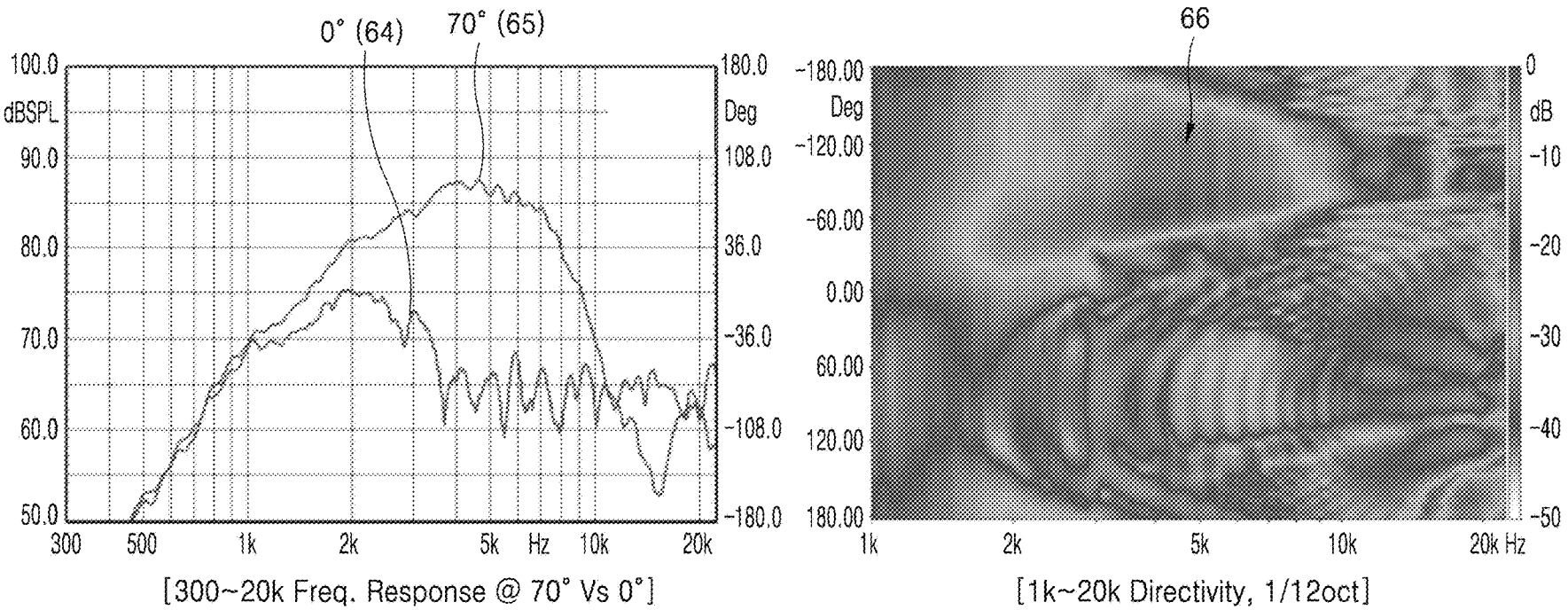
FIG. 6B is a graph and a spectrogram illustrating a change in frequency response and directivity characteristics after the attachment of covers according to an embodiment.

FIGS. 6A and 6B respectively are graphs and spectrograms illustrating a change in frequency response and directivity characteristics before and after the attachment of covers according to an embodiment.

FIG. 6A shows frequency response characteristics and directivity characteristics in a state in which the cover 15 including the acoustic-resistive material is not attached to the hole 12*a*.

Referring to FIG. 6A, with respect to the pipe 12, a function at 61 showing frequency response characteristics measured in a vertical-axis direction (0 degrees) has a waveform that is relatively similar to that of a function at 62 showing frequency response characteristics measured in a 70-degree direction from a vertical axis.

FIG. 6B shows frequency response characteristics and directivity characteristics in a state in which the cover 15 including the acoustic-resistive material is attached to the hole 12*a*.

Referring to FIG. 6B, with respect to the pipe 12, a function at 64 showing frequency response characteristics measured in the vertical-axis direction (0 degrees) has a waveform that is substantially different from that of a function at 65 showing frequency response characteristics measured in the 70-degree direction from the vertical axis. For example, in the case of the sound output apparatus 1 designed to have directivity characteristics of 70 degrees, the directivity characteristics may be improved at 70 degrees due to the attachment of the cover 15 including the acoustic-resistive material, and thus a waveform of the directivity characteristics may be different from a waveform measured at 0 degrees.

Also, directivity characteristics, shown in 66 of FIG. 6B, which are measured when the cover 15 including the acoustic-resistive material is attached to the holes 12*a*, are densely concentrated in one direction compared to directivity characteristics 63 of FIG. 6A measured when the cover 15 is not attached to the holes 12*a*.

Figure 7:
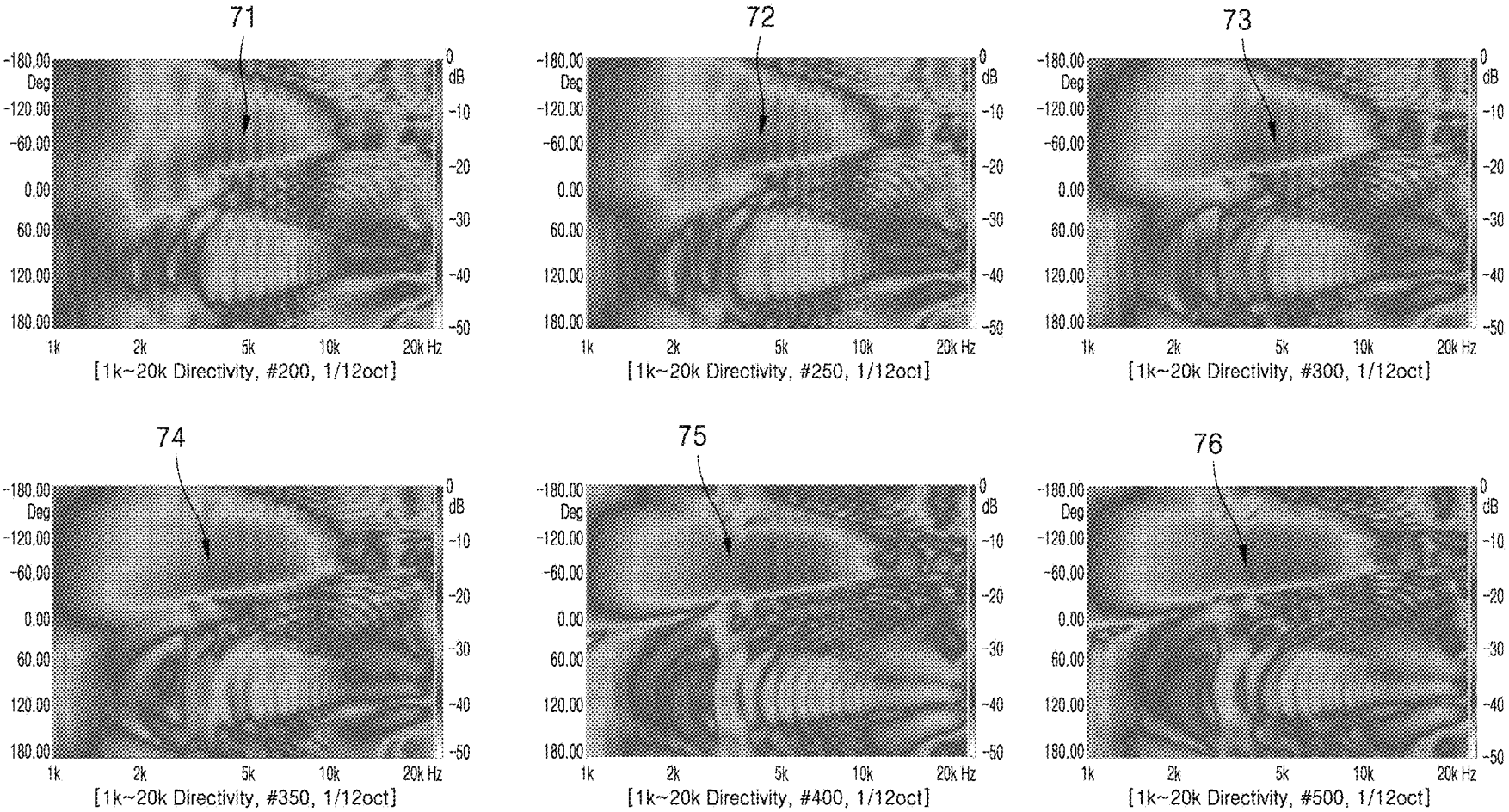
FIG. 7 shows spectrograms of acoustic characteristics based on various resistance degree of an acoustic-resistive material forming a cover according to an embodiment.

FIG. 7 shows spectrograms of acoustic characteristics according to various resistance degrees of an acoustic-resistive material forming a cover according to an embodiment.

According to an embodiment, the acoustic-resistive material may be cloth, metal, plastic, or the like. However, embodiments are not limited thereto.

Due to its unique characteristics, the acoustic-resistive material may have a certain resistance degree. Also, although acoustic-resistive materials may be of the same type, resistance degrees thereof may differ.

According to an embodiment, a unit indicating a degree of densely formed structures in the same area (e.g., about 1 inch) may be referred to as a stitch (e.g., #200 (200 stitches), #250 (250 stitches). A large number indicates a high acoustic resistance degree of structures that are densely formed.

A spectrogram 71 (200 stitches), a spectrogram 72 (250 stitches), a spectrogram 73 (300 stitches), a spectrogram 74 (350 stitches), a spectrogram 75 (400 stitches), and a spectrogram 76 (500 stitches) of FIG. 7 show that as the number of stitches of resistive materials becomes greater, waveforms are longer and narrowly and densely distributed. In other words, because an acoustic-resistive material having a great number of stitches has a high acoustic resistance degree, distortions due to interference sound decrease and desired directivity characteristics may be achieved.

Figure 8A:
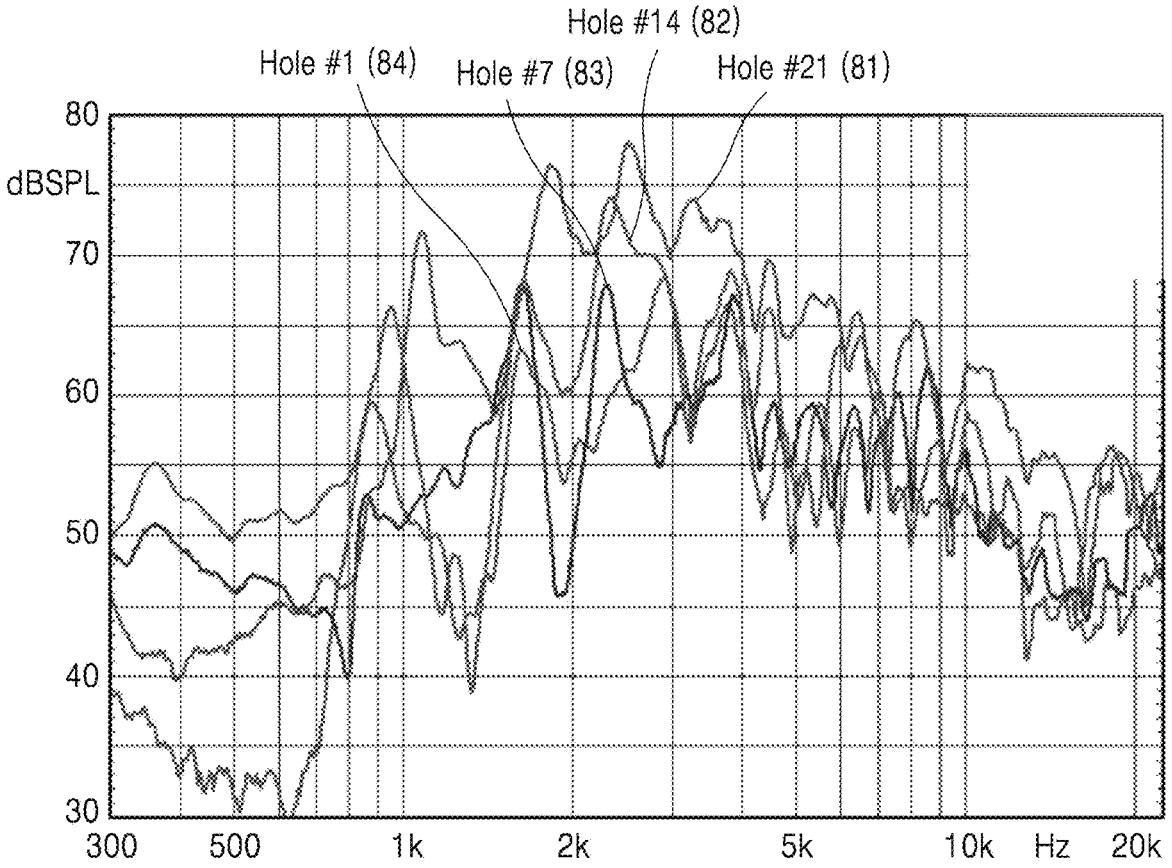
FIG. 8A is a graph illustrating frequency response characteristics based on cross-sectional areas of holes before covers are attached thereto, according to an embodiment.
Figure 8B:
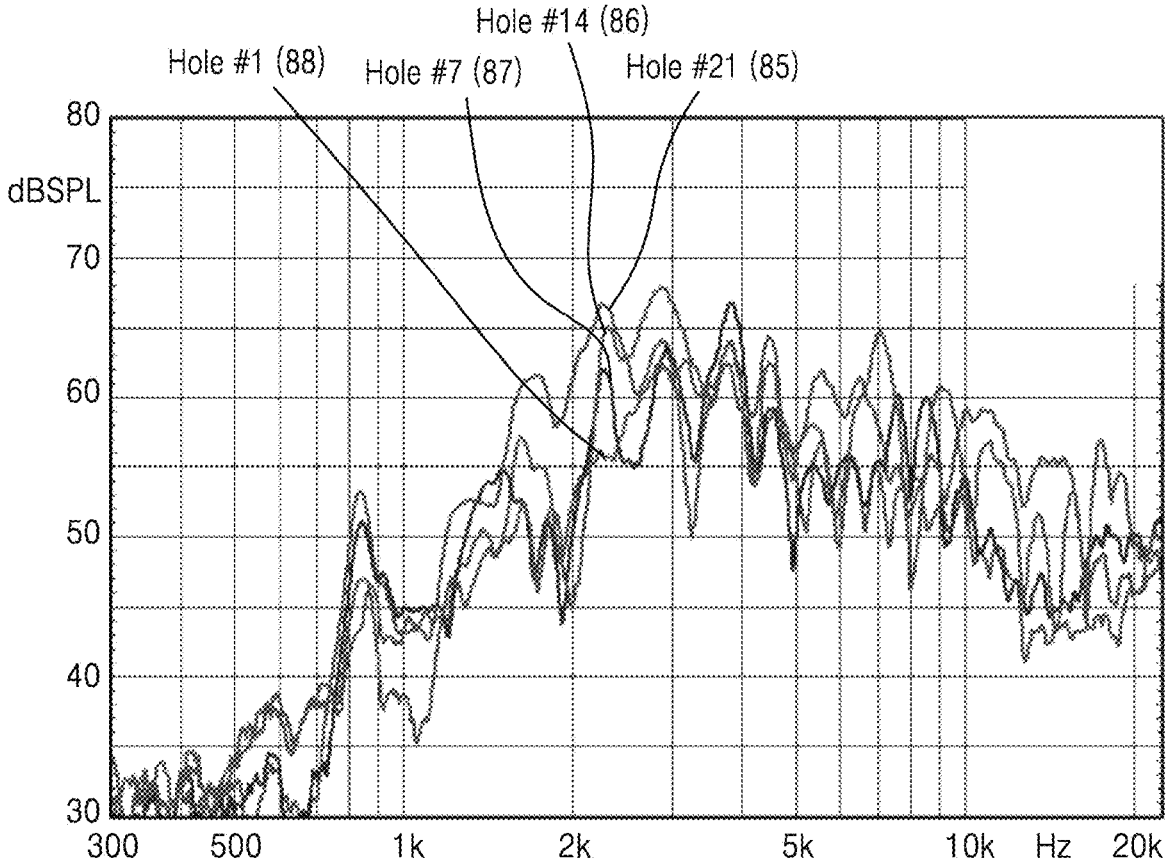
FIG. 8B is a graph illustrating frequency response characteristics based on cross-sectional areas of holes after covers are attached thereto, according to an embodiment.

FIG. 8A is a graph explaining frequency response characteristics based on cross-sectional areas of holes before covers are attached to the holes according to an embodiment. FIG. 8B is a graph explaining frequency response characteristics based on cross-sectional areas of holes after the covers are attached to the holes according to an embodiment.

As shown in FIG. 8A, a difference between waveforms of functions 81, 82, 83, and 84 according to sizes of the cross-sectional areas of the holes may be great. In contrast, FIG. 8B shows waveforms of functions 85, 86, 87, and 88 according to sizes of the cross-sectional areas of the holes that are similar to each other.

Compared to the functions 81, 82, 83, and 84 of FIG. 8A that are measured before the cover 15 is attached, the functions 85, 86, 87, and 88 of FIG. 8B, which are measured after the cover including the acoustic-resistive material is attached to the holes 12*a*, show that a sound pressure of the holes with the acoustic-resistive material is relatively uniform and consistency is improved.

Figure 9:
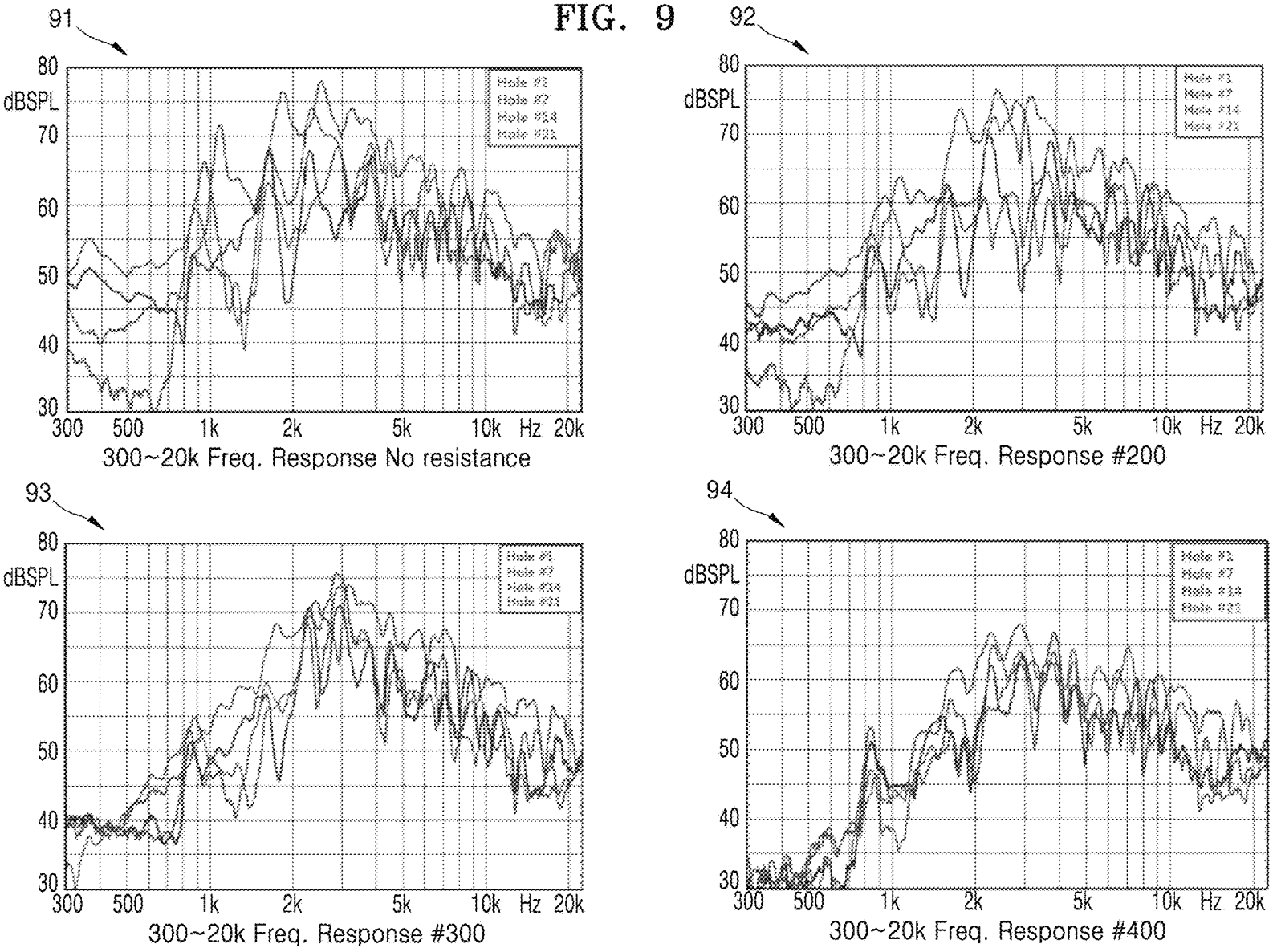
FIG. 9 shows graphs illustrating changes in a sound pressure of holes based on a resistance degree of an acoustic-resistive material forming a cover according to an embodiment.

FIG. 9 shows graphs illustrating changes in a sound pressure of holes according to a resistance degree of an acoustic-resistive material forming a cover according to an embodiment.

A graph 91 of FIG. 9 shows a measurement result before the cover including the acoustic-resistive material is attached, a graph 92 of FIG. 9 shows a measurement result after the cover including the acoustic-resistive material is attached, a graph 93 of FIG. 9 shows a measurement result after the cover including a 300-stitch material (#300) is attached, and a graph 94 of FIG. 9 shows a measurement result after the cover including a 400-stitch material (#400) is attached.

Referring to FIG. 9, the greater the number of stitches of the acoustic-resistive material, the higher the resistive degree, and thus, the sound pressure of the holes having different cross-sectional areas may be similar. In other words, the high resistance degree indicates that a sound pressure of respective holes become uniform and the consistency is improved.

For example, compared with a difference between waveforms of respective holes shown in the graph 92 measured using a 200-stitch resistive material, a difference between waveforms of respective holes shown in the graph 94 measured using a 400-stitch resistive material is relatively greater in uniformity, and the consistency is further improved.

According to an embodiment, as the cover 15 including the acoustic-resistive material is attached to cover the holes 12*a*, the directivity of sound in a certain direction may be improved. As the cover 15 including the acoustic-resistive material is attached to the holes 12*a* having different cross-sectional areas, the impedance values of the holes and a sound pressure become uniform, and thus, the directivity in the certain direction may be improved.

Figure 10:
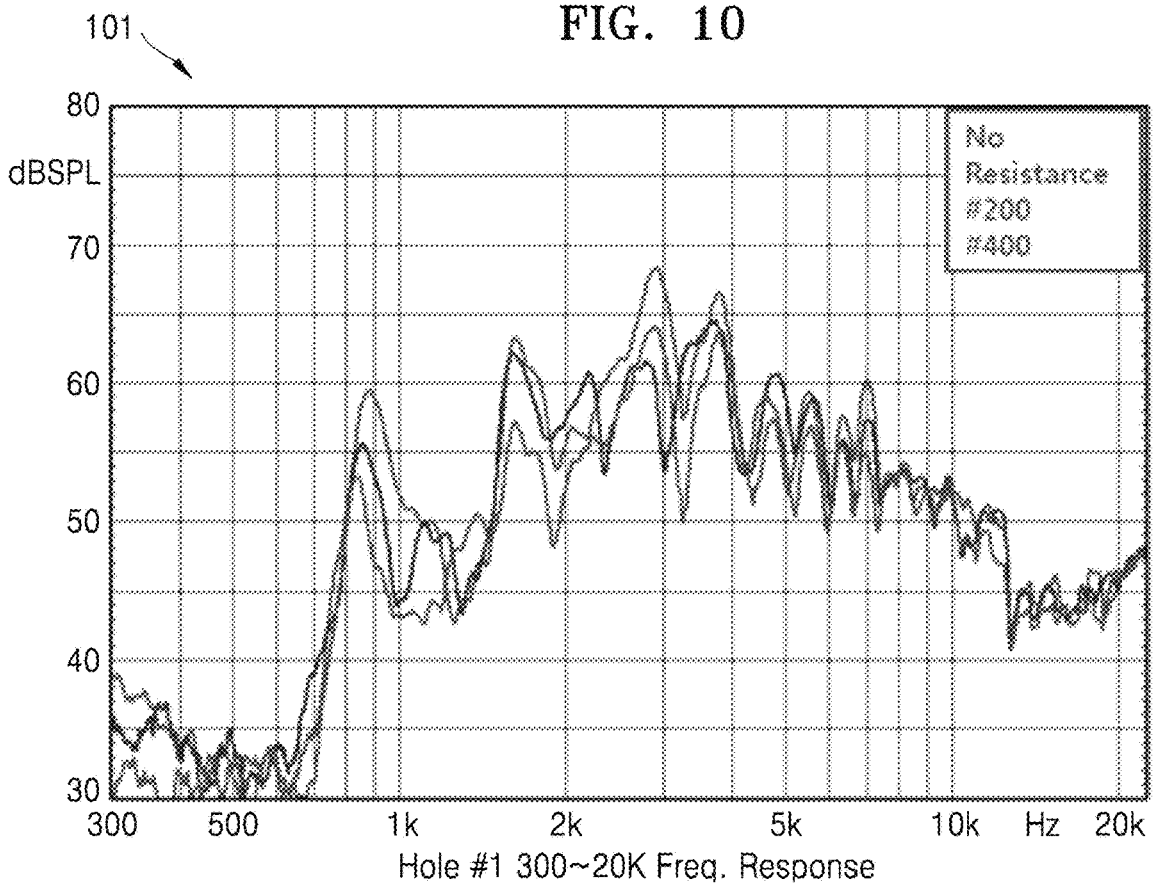
FIG. 10 shows graphs illustrating changes in a sound pressure of respective holes having different cross-sectional areas based on a resistance degree of an acoustic-resistive material forming a cover according to an embodiment.
Figure 10:
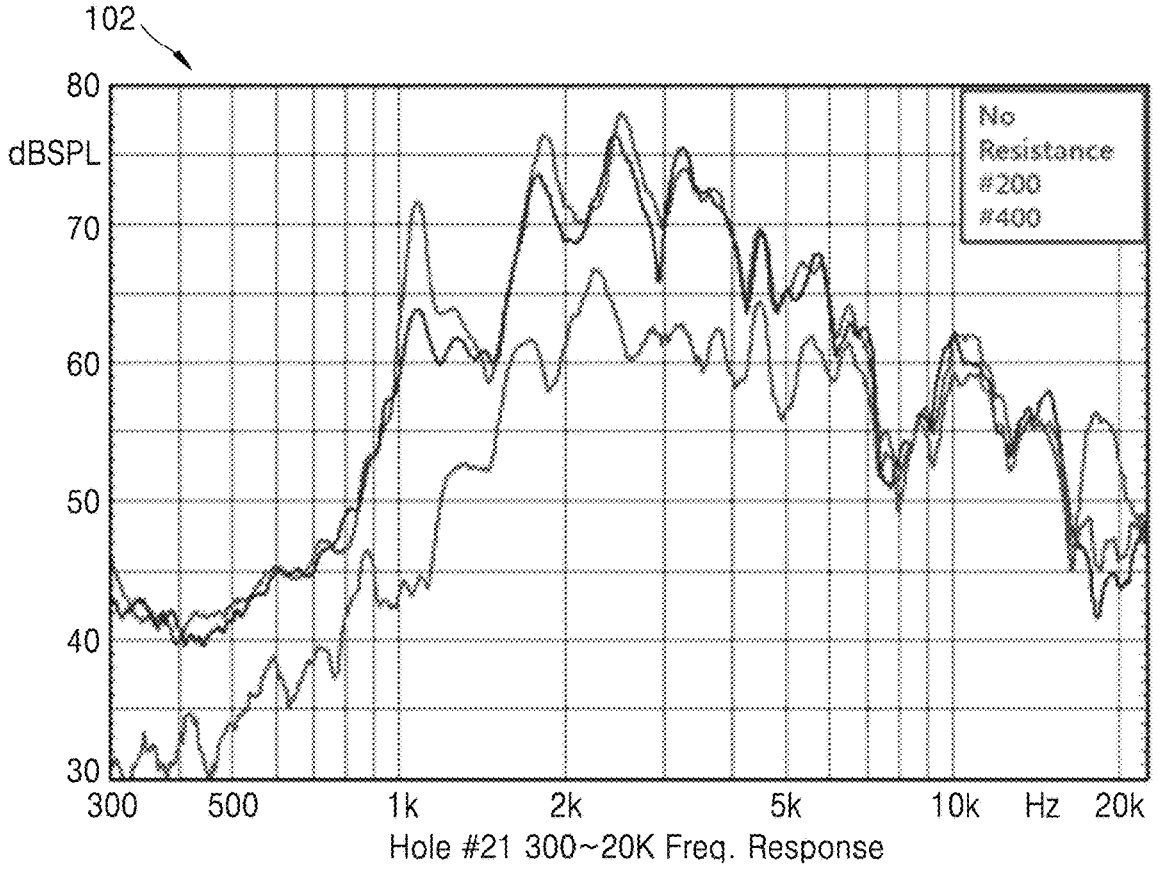

FIG. 10 shows graphs illustrating changes in a sound pressure of respective holes having different cross-sectional areas based on a resistance degree of an acoustic-resistive material forming a cover according to an embodiment.

For the convenience of explanation, a large hole number may indicate that a cross-sectional area of a hole is large. A graph 101 of FIG. 10 shows a sound pressure change measured in a hole of which a hole number is #1, and a graph 102 shows a sound pressure change measured in a hole of which a hole number is #21. For example, the hole #21 may have a larger cross-sectional area than the hole #1.

The graph 102 illustrates the sound pressure change measured in a hole having a relatively great cross-sectional area, and shows a greater sound pressure change for resistance degrees 200 stitches and 400 stitches of a single resistive material than the sound pressure change in graph 101 measured in a hole having a relatively small cross-sectional area. It is because an impedance change of the hole having the relatively greater cross-sectional area is larger. That is, as the size of a hole becomes greater, the sound pressure change may be greater according to the attachment of the resistive material.

Figure 11:
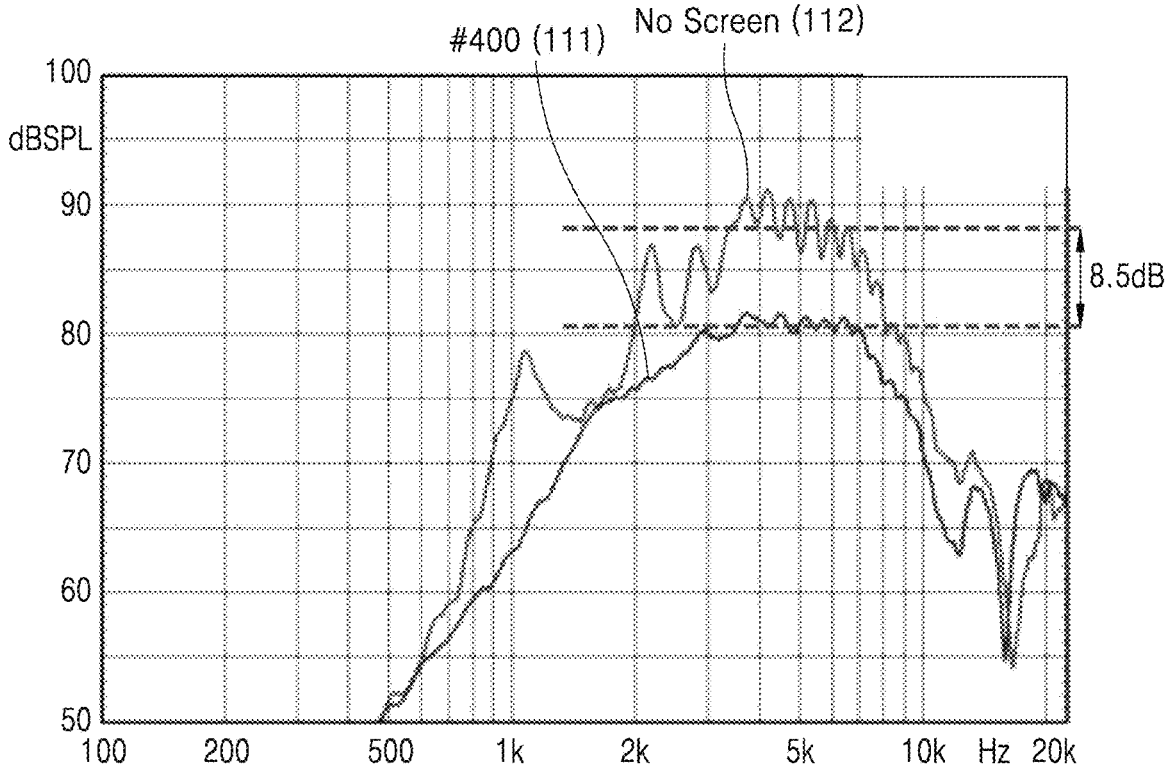
FIG. 11 is a graph illustrating a sound pressure change because of the attachment of a cover, according to an embodiment.

FIG. 11 is a graph illustrating a sound pressure change based on an attachment of a cover according to an embodiment.

Referring to FIG. 11, a sound pressure change 111 in the holes 12*a*, to which the cover 15 including the acoustic-resistive material (e.g., a 400-stitch acoustic-resistive material) is attached, is relatively lower than a sound pressure change 112 in the holes 12*a*, to which the cover 15 is not attached (e.g., a 8.5 dB decrease on average).

For example, when the cover including the acoustic-resistive material is attached to the holes, the flow of sound emitted from the driver to the pipe, in the air may be disturbed. That is, the impedances of the holes increase and the sound pressure decreases.

Figure 12:
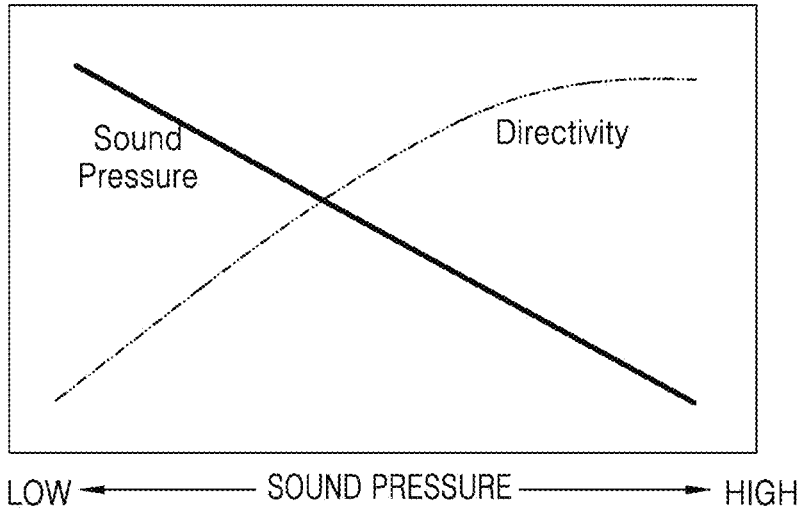
FIG. 12 is a graph illustrating directivity characteristics and a sound pressure change based on a resistance degree of an acoustic-resistive material according to an embodiment.

FIG. 12 is a graph explaining a sound pressure change and directivity characteristics based on a resistance degree of an acoustic-resistive material according to an embodiment.

Referring to FIG. 12, as the acoustic resistance increases, the sound pressure decreases, and as the acoustic resistance increases, the sound directivity also increases. In addition, when the acoustic resistance increases to at least a certain degree, the sound pressure continues to decrease, and a directivity change decreases.

Referring back to FIG. 7, when a resistance degree of the acoustic-resistive material increases to at least a certain point, it is found that, for example, a difference between a waveform of the graph 75 showing the acoustic characteristics of 400 stitches (#400) and a waveform of the graph 76 showing the acoustic characteristics of 500 stitches (#500) is not significantly great.

That is, an effect of an acoustic-resistive material reaching an optimal performance on the improvement of the directivity of the sound, the directivity of the sound reverses and tends to decrease.

According to another embodiment, when a cover includes a single resistive material, a resistance degree of the resistive material selected to form the cover may be greater than an average value of impedance values of holes. As yet another example, the resistance degree of the resistive material may be two times less than the greatest impedance value of the holes, that is, an impedance value of the smallest hole.

Figure 13A:
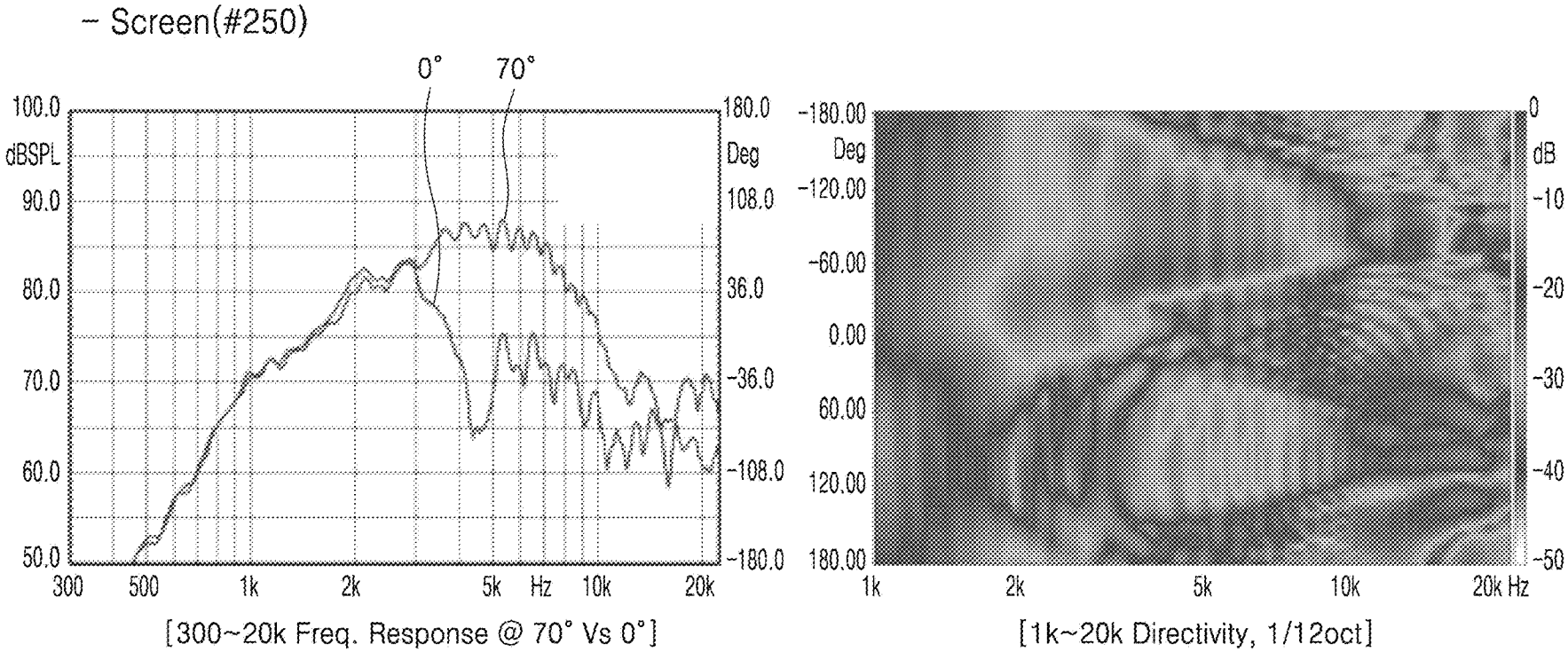
FIG. 13A is a graph and a spectrogram illustrating directivity characteristics based on an acoustic-resistive material according to an embodiment.
Figure 13B:
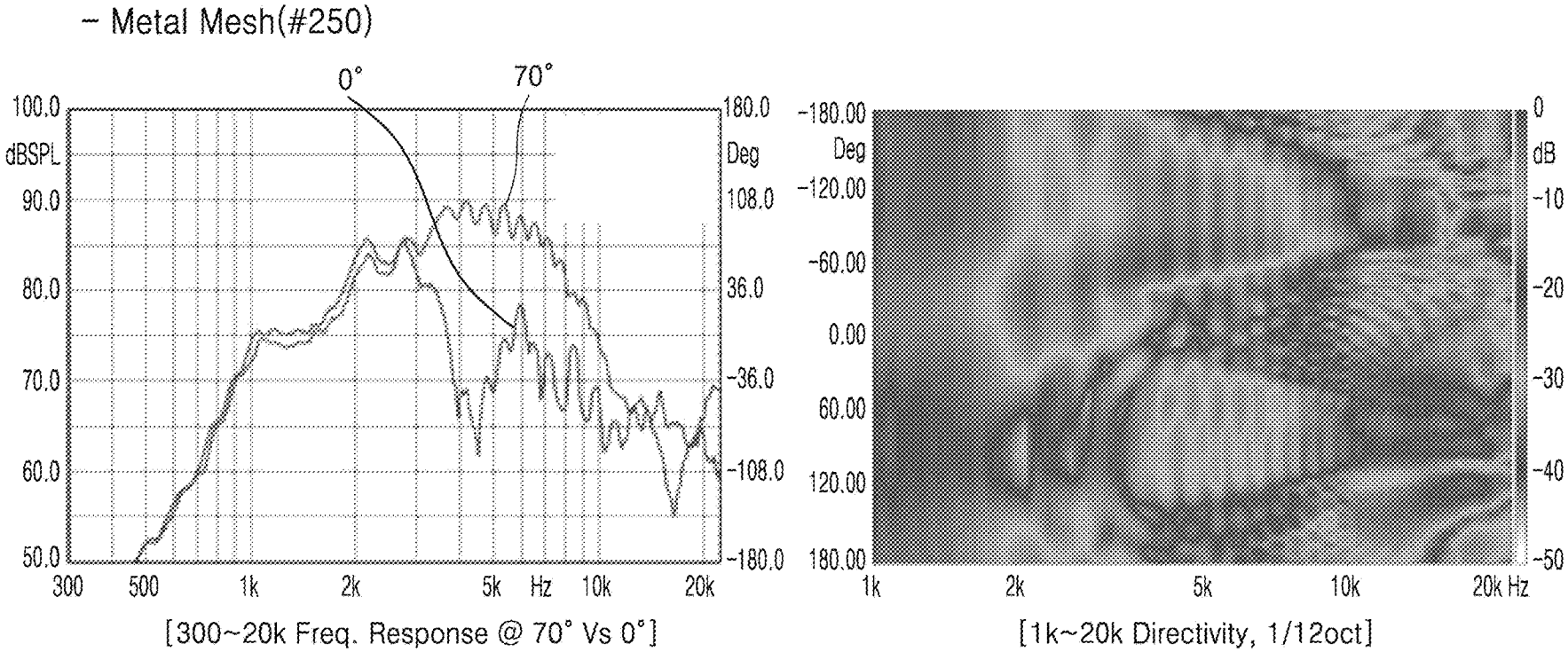
FIG. 13B is a graph and a spectrogram illustrating directivity characteristics based on an acoustic-resistive material according to an embodiment.

FIGS. 13A and 13B are graphs and spectrograms illustrating directivity characteristics based on an acoustic-resistive material according to an embodiment.

FIG. 13A shows the directivity characteristics when a screen including 250 stitches (#250) is used as an acoustic-resistive material. FIG. 13B shows the directivity characteristics when a metal mesh including 250 stitches (#250) is used as an acoustic-resistive material.

As shown in FIGS. 13A and 13B, in the case of the acoustic-resistive materials having the same stitches (e.g., 250 stitches (#250)), although types of materials are different, the directivity characteristics are similar.

Figure 14A:
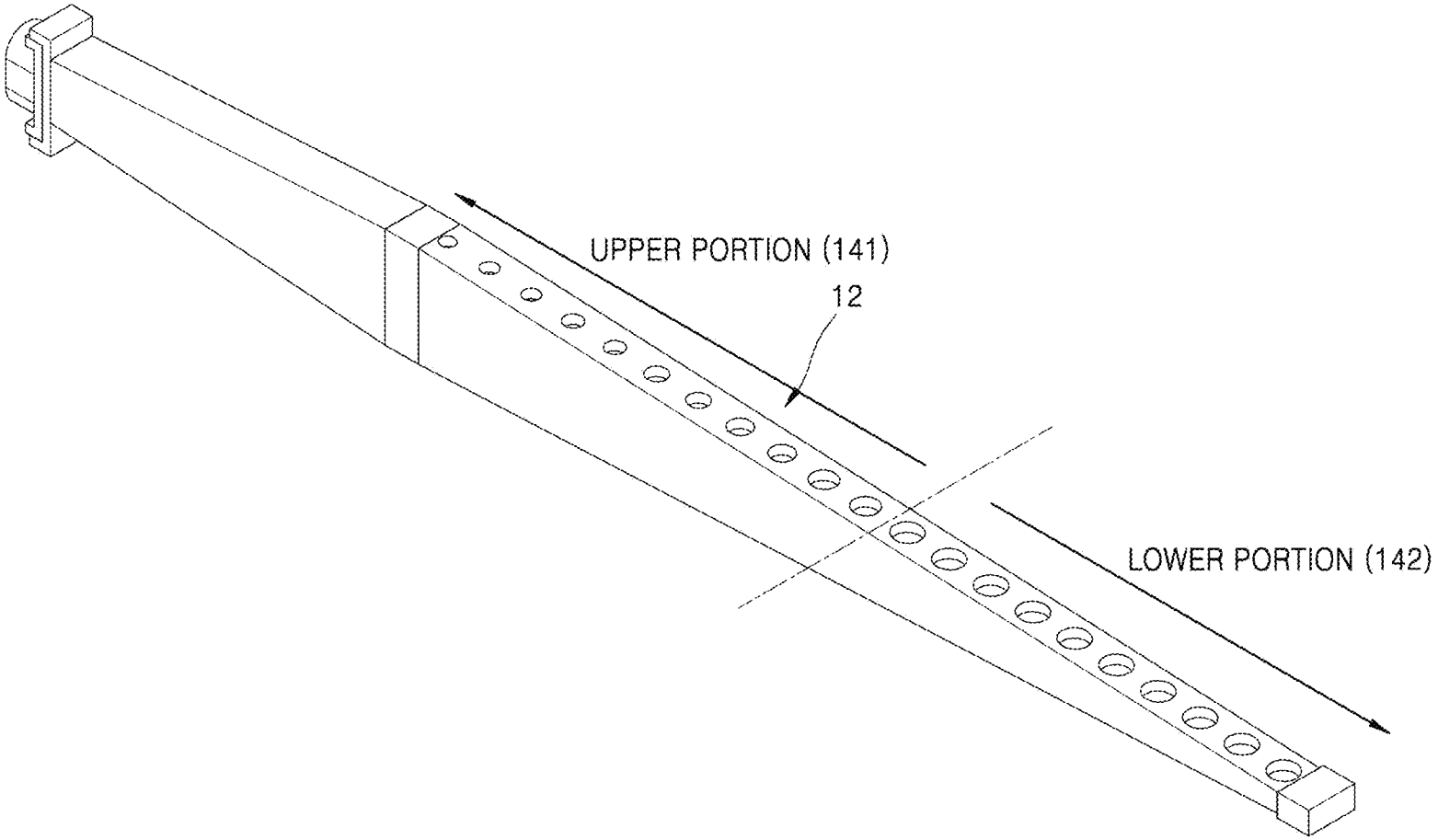
FIG. 14A is a diagram illustrating an example of covers including two types of acoustic-resistive materials that are attached to a sound output apparatus according to an embodiment.
Figure 14B:
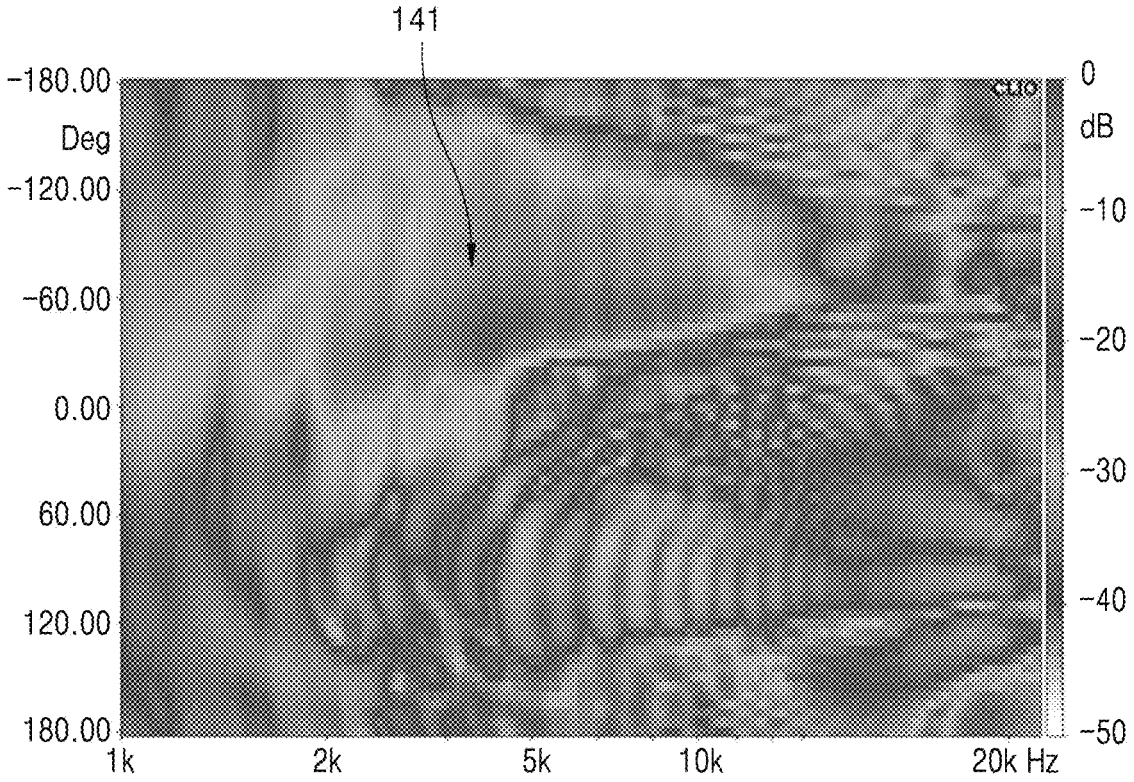
FIG. 14B is a spectrogram illustrating directivity characteristics based on the attachment of the cover including two types of acoustic-resistive materials according to an embodiment.

FIG. 14A is a diagram illustrating an example of covers including two types of acoustic-resistive materials that are attached to a pipe according to an embodiment. FIG. 14B is a spectrogram showing directivity characteristics according to the attachment of the cover including two types of acoustic-resistive materials according to an embodiment.

Referring to FIG. 14A, the pipe 12 may be divided into two portions. For example, the pipe 12 may be divided into an upper portion 141 and a lower portion 142, and covers including two different types of acoustic-resistive materials may be attached thereto.

Specifically, a first cover may be formed by using an acoustic-resistive material that may be appropriate for the holes included in the upper portion 141. A second cover may be formed by using an acoustic-resistive material that may be appropriate for the holes included in the lower portion 142.

For example, FIG. 14B shows a spectrogram illustrating sound directivity characteristics 141 when a cover including a 180-stitch acoustic-resistive material (#180) is attached to the upper portion 141 and a cover including a 500-stitch acoustic-resistive material (#500) is attached to the lower portion 142.

As shown in FIG. 14A, when different acoustic-resistive materials are selected for two portions of the pipe (e.g., the upper portion 141 and the lower portion 142), acoustic-resistive materials may be selected accordingly based on the characteristics of the holes included in the divided portions. The acoustic-resistive materials may be selected so that total impedance values, that is, a sum of an impedance value according to a cross-sectional area of a hole and an impedance value of a resistive material, be similar to each other.

Figure 14C:
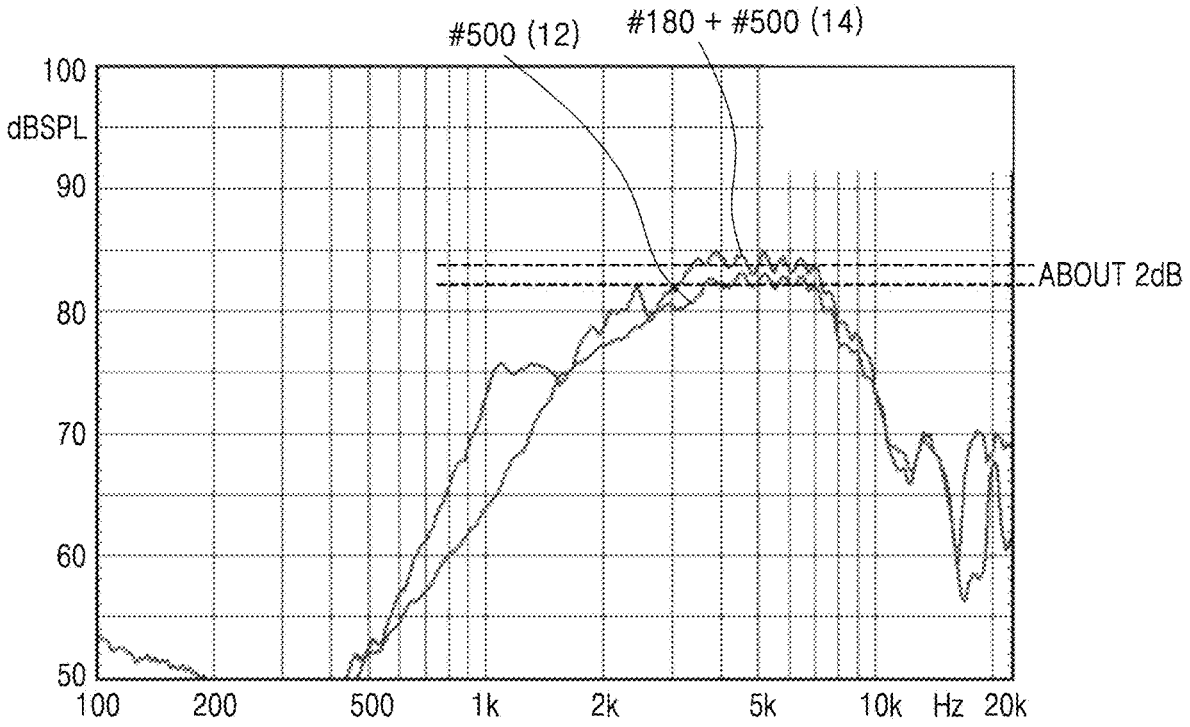
FIG. 14C is a graph illustrating a sound pressure change as a cover including two types of acoustic-resistive materials is attached according to an embodiment.

FIG. 14C is a graph illustrating a sound pressure change based on the attachment of a cover including two types of acoustic-resistive materials according to an embodiment.

Referring to FIG. 14C, a function representing a sound pressure 14 measured with two types of materials, such as a 180-stitch acoustic-resistive material (#180) and a 500-stitch acoustic-resistive material (#500) is greater than a function representing a sound pressure 12 measured with a single material, such as a 500-stitch acoustic-resistive material (#500) having a relatively high acoustic resistance degree. Specifically, the sound pressure 14 is higher than the sound pressure 12 at about 2 dB on average. Accordingly, the sound directivity characteristics may be maintained by using different types of materials for acoustic-resistive material attached to the pipe.

Therefore, to obtain a high sound pressure to improve the sound emitted from the sound output apparatus 1, two acoustic-resistive materials may be used instead of a single acoustic-resistive material having a relatively high resistance degree. Accordingly, the sound pressure may be increased and desired directivity characteristics may be maintained.

Descriptions of one or more embodiments are merely examples, and it may be understood by one of ordinary skill in the art that various changes in form and details may be made therein without departing from the spirit and scope of the disclosure as defined by the appended claims. Thus, one or more embodiments are merely examples and should not be construed as being limited to the embodiments set forth herein. For example, components that are described as a single piece may be separated, and components that are described as being separated may be integrated.

The use of any and all examples and exemplary language provided herein is intended merely to explain the disclosure and does not limit the scope of the disclosure unless otherwise provided.

Moreover, no item or component is essential to the practice of the disclosure unless the element is specifically described as "essential" or "critical".

Throughout this disclosure, the description "A may include one of a1, a2 or a3" may mean, in a broad sense, that example elements that may be included in the element A are a1, a2, or a3.

Due to the above described description, the elements forming the element A are not limited to a1, a2, or a3. Therefore, the element that may be included in the element A should not be exclusively construed as being limited to a1, a2, and a3 or excluding other elements that are not specified herein.

The description means that the element A may include a1, may include a2, or may include a3. The description does not mean that elements included in the element A should be selectively determined from a preset group. For example, the description should not be construed as being limited to a1, a2, or a3 selected from a group necessarily including a1, a2, and a3 comprising a component A.

In addition, the expression "at least one of a1, a2, and a3" indicates only a1, only a2, only a3, both a1 and a2, both a1 and a3, both a2 and a3, all of a1, a2, and a3, or variations thereof. Therefore, unless otherwise stated as "at least one of a1, at least one of a2, and at least one of a3", the expression "at least one of a1, a2, and a3" should not be construed as "at least one of a1", "at least one of a2", and "at least one of a3".

While embodiments have been particularly shown and described, it will be understood by those of ordinary skill in the art that various changes in form and details may be made therein without departing from the spirit and scope of the disclosure as defined by the following claims.

What is claimed is:

1. A sound output apparatus comprising:

a driver configured to emit sound;

a pipe comprising a plurality of holes that are aligned in a row in a side surface of the pipe, and are configured to receive the sound emitted from the driver; and at least one cover covering the plurality of holes, wherein impedance values of the plurality of holes which are covered by the at least one cover are substantially equal to each other within a preset range, and wherein, the at least one cover in a state in which the at least one cover is not attached to the plurality of holes, a sum of an impedance value of a first hole from among the plurality of holes and impedance value of a first cover corresponding to the first hole is substantially equal to a sum of an impedance value of a second hole from among the plurality of holes and an impedance value of a second cover corresponding to the second hole, within the preset range.

2. The sound output apparatus of claim 1, wherein the at least one cover is attached to the plurality of holes, and an impedance value of the at least one cover is greater than an average of the impedance values of the plurality of holes and two times less than a maximum value of the impedance values of the plurality of holes.

3. The sound output apparatus of claim 1, wherein the at least one cover is attached to cover the plurality of holes from inside or outside of the pipe.

4. The sound output apparatus of claim 1, wherein the at least one cover comprises an acoustic-resistive material, and the acoustic-resistive material comprises at least one of cloth, plastic, or metal.

5. The sound output apparatus of claim 1, wherein the at least one cover has a circular shape, an oval shape, or a rectangular shape.

6. The sound output apparatus of claim 1, wherein the at least one cover comprises at least one layer of at least one acoustic-resistive material.

7. The sound output apparatus of claim 1, wherein a cross-sectional area of the plurality of holes gradually increases or decreases in a direction along the row.

8. The sound output apparatus of claim 1, wherein the pipe comprises at least two portions, and the at least one cover comprises at least two covers comprising different acoustic-resistive materials that are respectively attached to the at least two portions to cover the plurality of holes in each of the at least two portions.

9. A display apparatus comprising:

a display; and a pair of sound output apparatuses respectively extending toward opposite sides of the display, wherein each of the pair of sound output apparatuses comprises:

a driver configured to emit sound;

a pipe comprising a plurality of holes that are aligned in a row in a side surface of the pipe, and are configured to receive the sound emitted from the driver; and at least one cover covering the plurality of holes, wherein impedance values of the plurality of holes which are covered by the at least one cover have substantially equal values within a preset range, and wherein, the at least one cover in a state in which the at least one cover is not attached to the plurality of holes, a sum of an impedance value of a first hole from among the plurality of holes and impedance value of a first cover corresponding to the first hole is substantially equal to a sum of an impedance value of a second hole from among the plurality of holes and an impedance value of a second cover corresponding to the second hole, within the preset range.

10. The display apparatus of claim 9, wherein the at least one cover is attached to the plurality of holes, and an impedance value of the at least one cover is greater than an average of the impedance values of the plurality of holes and two times less than a maximum value of the impedance values of the plurality of holes.

11. The display apparatus of claim 9, wherein the at least one cover is attached to cover the plurality of holes from inside or outside of the pipe.

12. The display apparatus of claim 9, wherein the at least one cover comprises an acoustic-resistive material, and the acoustic-resistive material comprises at least one of cloth, plastic, or metal.

* * * * *